US009423209B1

(12) United States Patent
Hoeffken

(10) Patent No.: US 9,423,209 B1
(45) Date of Patent: Aug. 23, 2016

(54) SELF-GUIDED RACKING ASSIST SYSTEM, TOOL AND METHOD FOR CHARGING A HANDGUN

(71) Applicant: Russell W. Hoeffken, Millstadt, IL (US)

(72) Inventor: Russell W. Hoeffken, Millstadt, IL (US)

( * ) Notice: Subject to any disclaimer, the term of this patent is extended or adjusted under 35 U.S.C. 154(b) by 0 days.

(21) Appl. No.: 14/840,173

(22) Filed: Aug. 31, 2015

Related U.S. Application Data

(60) Provisional application No. 62/104,115, filed on Jan. 16, 2015.

(51) Int. Cl.
*F41C 27/00* (2006.01)

(52) U.S. Cl.
CPC ..... *F41C 27/00* (2013.01)

(58) Field of Classification Search
CPC ..... F41C 27/00; F41A 7/00; F41A 7/02; F41A 9/38; F41A 19/34; F41A 19/47
USPC ..... 42/90, 106; 89/1.4
See application file for complete search history.

(56) References Cited

U.S. PATENT DOCUMENTS

| | | | | | |
|---|---|---|---|---|---|
| 2,356,538 | A * | 8/1944 | Schmeisser | F41A 19/03 | 42/106 |
| 3,763,587 | A * | 10/1973 | Firmalino | F41A 19/34 | 224/249 |
| 4,043,065 | A | 8/1977 | Musgrave | | |
| 4,138,044 | A * | 2/1979 | Musgrave | F41C 33/0218 | 224/242 |
| 4,298,150 | A * | 11/1981 | Seldeen | F41C 33/0227 | 224/238 |
| 5,111,608 | A * | 5/1992 | Weisheit | F41A 15/22 | 42/106 |
| 5,438,907 | A * | 8/1995 | Reynolds | F41A 21/32 | 102/530 |
| 7,942,090 | B1 * | 5/2011 | Hoffman | F41A 21/32 | 42/76.01 |
| 8,191,301 | B2 | 6/2012 | Hatfield | | |
| 8,312,803 | B2 * | 11/2012 | Oz | F41A 19/34 | 42/71.02 |
| 8,438,774 | B2 | 5/2013 | Sharp et al. | | |
| 8,468,734 | B2 * | 6/2013 | Meller | F41A 3/72 | 42/71.02 |
| 8,549,785 | B2 | 10/2013 | Sharp et al. | | |
| D702,800 | S * | 4/2014 | Speroni | D22/108 | |
| D724,689 | S * | 3/2015 | Sui | D22/108 | |
| 9,121,662 | B1 * | 9/2015 | Love | F41C 27/00 | |
| 9,157,691 | B2 * | 10/2015 | Parnell | F41A 7/00 | |
| 9,194,636 | B2 * | 11/2015 | McAninch | F41A 7/00 | |
| 9,194,654 | B1 * | 11/2015 | Viani | F41C 27/00 | |
| 9,239,207 | B2 * | 1/2016 | Kresser | F41A 3/72 | |
| 2011/0154710 | A1 | 6/2011 | Hatfield | | |
| 2011/0283587 | A1 | 11/2011 | Sharp et al. | | |
| 2013/0180152 | A1 | 7/2013 | Speroni | | |
| 2013/0220105 | A1 | 8/2013 | Sharp et al. | | |
| 2013/0255478 | A1 | 10/2013 | McAninch | | |
| 2014/0298703 | A1 | 10/2014 | Gale et al. | | |
| 2015/0184959 | A1 | 7/2015 | Parnell | | |
| 2015/0300776 | A1 * | 10/2015 | Lee | F41A 35/00 | 42/90 |

OTHER PUBLICATIONS

Ease-Z-Rack, http://www.ebay.com/itm/131482281350, accessed Aug. 21, 2015, 3 pages.
Handi-Racker, http://handi-racker.com, accessed Aug. 21, 2015, 3 pages.
Rack-It Gun Racking Assistive Device, http://rack-it.org, accessed Aug. 21, 2015, 4 pages.

* cited by examiner

*Primary Examiner* — Joshua Freeman
(74) *Attorney, Agent, or Firm* — Armstrong Teasdale LLP

(57) ABSTRACT

A self-guided racking assist system for charging a handgun includes a racking assist device that is adapted for self-guided sliding assembly with a barrel of the handgun via a guide rod member and a cylindrical member defining a cavity therebetween. When the racking assist device is seated on a support surface, the handgun may easily be pushed against the racking assist device to charge the handgun.

8 Claims, 6 Drawing Sheets

SECTION A-A

SECTION C-C

SELF-GUIDED RACKING ASSIST SYSTEM, TOOL AND METHOD FOR CHARGING A HANDGUN

CROSS REFERENCE TO RELATED APPLICATIONS

This application claims the benefit of U.S. Provisional Application Ser. No. 62/104,115 which is hereby incorporated by reference in its entirety.

BACKGROUND OF THE INVENTION

The field of the invention relates generally to accessory devices and methods for assisting in charging a semi-automatic handgun and, more particularly, to a self-guided racking assist device, systems and methods for aiding an operation of a slide assembly of a handgun.

Semi-automatic handguns, sometimes referred to as pistols, are conventionally manually operated by a user holding the handgun with one hand, and grasping a spring-loaded slide assembly with the user's fingers of the other hand and pulling or pushing the slide assembly toward the rear of the handgun assembly. When the slide is moved rearward by a sufficient amount, a cartridge or round is exposed from a magazine loaded in the handgun. When the slide is released by the user, a spring forces the slide forward and places the cartridge into the chamber such that the handgun is ready for use. This process is sometimes referred to as charging the handgun and occasionally is more simply referred to as "racking". At least to some users, successfully racking a handgun presents certain difficulties, and improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
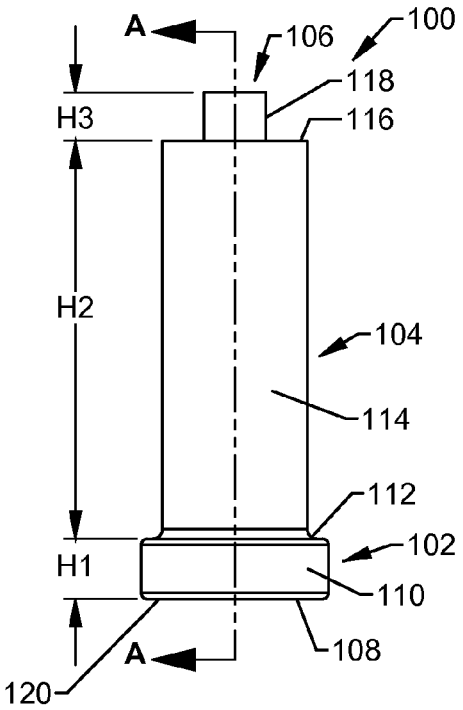
FIG. 1 is a side elevational view of a first exemplary embodiment of a racking assist device for charging a handgun.

In order to understand the invention to its fullest extent, some discussion of the state of the art and related problems in the art is discussed below, followed by exemplary embodiments of the present invention that address those problems.

For semi-automatic handgun users, moving the handgun slide rearward against the force of the spring by hand and/or fingers presents challenges and difficulties for certain types of users. Specifically, persons having certain physical limitations may lack the hand and/or finger strength needed to pull or push the slide rearward against the force of the spring to load a cartridge in the chamber and complete the racking process. If the racking process cannot be successfully completed the handgun cannot be used. Even if the racking process can be completed by such users, difficulty in accomplishing it (singly or repeatedly) may impair the practical use and enjoyment of the handgun.

A variety of techniques are known to assist a user with movement of the slide and facilitate an easier racking operation of a handgun, but known solutions are problematic in some aspects and have yet to completely meet the needs of the marketplace. Specifically, known solutions to improve racking of a handgun tend to be impractical, undesirably expensive, and/or pose certain safety issues.

For example, modifications to the handguns themselves have been proposed to aid a user's operation of the slide of the handgun. Such modifications include features built-in to the handgun slide or separately provided devices that are attached and fastened to the handgun. Such solutions are relatively expensive, however, and can present reliability issues over time. Modifications and attachments also tend to add to the weight of the handgun in use and present balance issues that can negatively affect the use of the handgun after racking is completed. As such, while the handgun may indeed be easier to charge when such solutions are implemented, the solutions may interfere with enjoyment of the gun to fire cartridges or rounds by making it more difficult to accurately hit a target.

Charging holsters and charging systems are also known that can be effective to some extent in facilitating the handgun racking processes without modification or attachment of devices to handguns as described above, but charging holsters and systems tend to be relatively expensive and bulky solutions as well as inconvenient in some aspects. As one example, certain types of holsters require items such as belts to be worn by the user, and as such a user may have to procure a belt or change clothes in order to use the charging holster, and attaching and removing the holster from the belt can be a nuisance. Additionally, charging holsters and certain types of known charging systems cannot be effectively used by persons with certain physical limitations, including but not necessarily limited to persons needing a wheelchair. A seated person may not use such known devices of this type safely, if at all.

Certain types of accessory devices are also known to aid a user in charging of a handgun. Such devices, however, often require two handed operation to use wherein one hand grips the handgun and the other grips the accessory. Known accessory devices also tend to require a user to place an object in front of a muzzle of a loaded handgun in use, which in turn often requires a user to place their hand or another part of their body in front of the muzzle of the handgun, presenting undesirable safety risks posed by accidental discharge of the handgun while such devices are being used. Also, certain accessory devices are prone to alignment issues and difficulties between the handgun and the accessory device. Certain users may have difficulty in establishing or maintaining the proper alignment to successfully complete the charging of the handgun.

US Patent Application Publication No. 2013/0255478 describes a handgun charging system including a relatively small body that may be manually and removably coupled to a handgun over the top of the slide and assist in the movement of the slide. While the charging system described in US Patent Application Publication No. 2013/0255478 can be effective for some users, it is nonetheless disadvantaged because the charging system requires a user to hold the handgun with his or her first hand and hold the body with his or her second hand while guiding movement of the body relative to the handgun with the second hand. For users with certain types of physical limitations, such two-handed operation of the charging system requires strength and dexterity that certain users do not possess. As a result, successful racking of a handgun can still be difficult, if not impossible, to accomplish.

US Patent Application Publication No. 2015/00184959 also proposes an apparatus that adjustably couples to a handgun slide and requires a two handed operation and a certain degree of coordination to successfully charge a handgun. Again, not all users have the requisite strength and dexterity to successfully accomplish a two-handed racking operation using such an apparatus.

Lower cost and easier to use solutions offering improved safety are desired for assisting in charging handguns. Smaller and lighter weight solutions are desired. Reliable use by an expanded number of users is also desired. Such desires, however, have until now proven to be elusive and longstanding and unresolved needs in the marketplace have yet to be met.

Exemplary embodiments of self-guided racking assist devices are described hereinbelow that overcome these and other disadvantages in the art and fulfill longstanding and unresolved needs in the art. The inventive self-guided racking assist device may implement handgun racking systems and methods that are advantageously and reliably utilized by handgun users with physical limitations who otherwise would have difficulty operating the slide of the handgun in use. Safe, effective and convenient one-handed racking operation of a handgun is made possible using a lightweight, relatively inexpensive and, when desired, easily transportable racking assist device. Method aspects will be in part apparent and in part explicitly discussed in the description below.

As explained in further detail below, the self-guided racking assist device enables charging of a handgun via operation of the slide of a handgun with a simple pushing force applied by the user's palm, as opposed to a pulling or pushing force applied by the user's fingers, and the self-guiding nature of the racking assist device reduces or eliminates alignment problems with the handgun that may otherwise impair the racking operation. A relatively small racking assist device is provided that may be easily engaged to and disengaged from the barrel of a handgun without requiring the user to place their hand or any part of their body in front of the muzzle of the handgun. The racking assist device includes a guide rod that receives a bore of the handgun barrel in use, and a cylindrical member, sometimes referred to as a shroud, that may be received over the barrel of the gun as the user engages the handgun with the racking assist device. The handgun barrel is therefore guided over the racking assist device from the inside and the outside. When the handgun is pushed or pressed against a support surface with the racking assist device in place and engaged with the handgun, the cylindrical member engages the slide and the slide is moved rearward to charge the gun. The racking assist device is easily decoupled from the barrel once the gun is charged.

The racking assist device may include mounting features allowing the device to be mounted and fastened to a support surface to facilitate a system including the racking assist device for still further user convenience and for further simplification racking the handgun. Contemplated embodiments are structured to be fastened to various types of support structures. A non-slip feature may be provided in the racking assist device to facilitate secure positioning of the tool on a support surface, whether or not the racking assist device is actually fastened to a support surface. Virtually any support surface or support structure may be utilized for ease of use in various indoor and outdoor locations, and primary and second mounting brackets are contemplated to mount the racking assist device in a desired location. In this regard, certain embodiments are uniquely designed for attachment to a wheel chair.

A lanyard may be coupled to the racking assist device to facilitate certain uses of the racking assist tool. The racking assist device may be manufactured in a relatively low cost manner, while providing a highly reliable and safe charging system when used. The racking assist device may be fabricated from relatively low cost materials, including but not limited to plastic materials and may be fabricated in a single piece or assembled from multiple separately fabricated pieces. The racking assist devices in completed embodiments are lightweight and small enough, for example, to be carried is a user's pocket.

FIGS. 1-4 depict various views of an exemplary embodiment of a racking assist device 100 according to the present invention that provides the benefits described above to overcome problems and disadvantages in the art. As shown in FIGS. 1-4, the exemplary racking assist device 100 generally includes a base member 102, a cylindrical member 104 extending from the base member 102, and a guide rod member 106 extending from the base member 102.

The base member 102 in the racking assist device 100 is includes a flat or planar bottom wall 108, a generally round or circular side wall 110 extending generally perpendicular to the plane of the bottom wall 108, and a transition section 112 extending opposite the bottom wall 108. Dimensionally, the diameter of the bottom wall 108 is much greater proportioned than the height of the side wall 110. That is, the height-to-width ratio of the device much less than one to provide a relatively large bottom wall 108 in the width dimension but a relatively small or compact side wall in the height dimension. In one contemplated embodiment, the base member 102 may be formed with a height dimension $H_1$ (FIG. 1) of about 0.375 inches (0.95 cm) and a diameter $D_1$ (FIG. 2) of about 0.97 inches (2.46 cm). The handgun enthusiast will realize that the diameter $D_1$ of the base member 102 is only slightly larger than the outer circumference of the barrel of existing handguns. Since the base member 102 is the largest portion of the device 100 in the width dimension, the device 100 is relatively slim and compact enough to be grasped and handled with only two fingers, and the device 100 is also small enough to easily and comfortably fit in a person's pocket, a small carrying bag, backpack, a purse, a vehicle glove box or console, etc.

Figure 2:
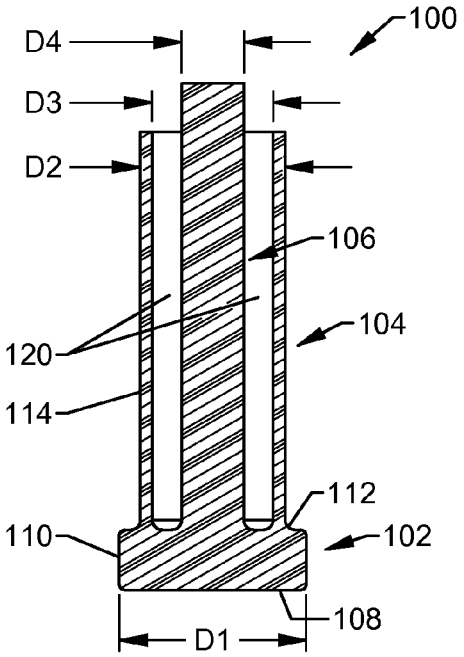
FIG. 2 is a cross sectional view of the racking assist device shown in FIG. 1 and taken along line A-A.
Figure 3:
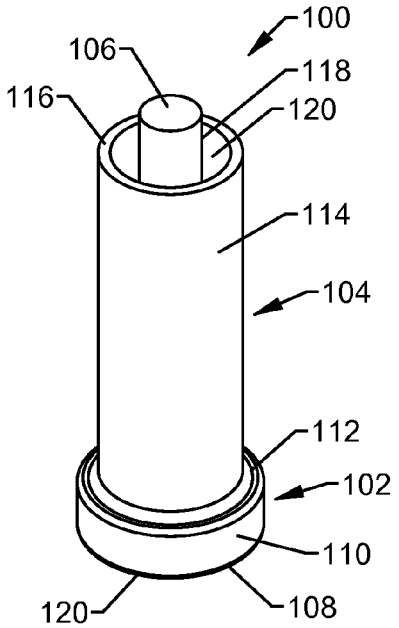
FIG. 3 is a top perspective view of the racking assist device shown in FIGS. 1 and 2.
Figure 4:
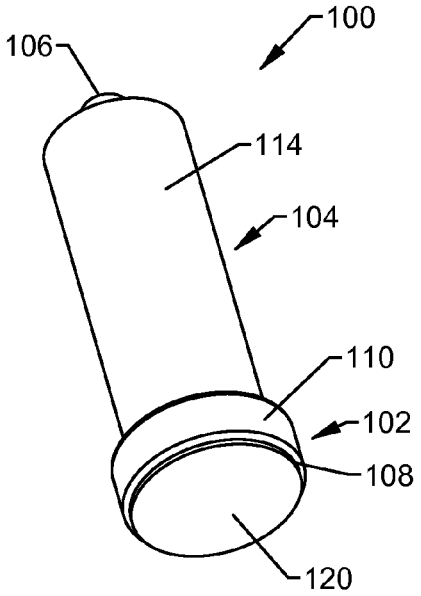
FIG. 4 is a bottom perspective view of the racking assist device shown in FIGS. 1 through 3.

The cylindrical member 104 extends above the transition section 112 of the base member 102 and in the example shown includes a round or cylindrical side wall 114 that also extends perpendicularly to the plane of the bottom wall 108 of the base member 102. The side wall 114 is formed with an outer diameter $D_2$ and an inner diameter $D_3$ (FIG. 2). The inner diameter $D_3$ is larger than an outer diameter of the barrel of the semi-automatic handgun to be charged. As such, the barrel of the handgun may be slidably received in the cylindrical member 104 as further explained below. The distal end of the cylindrical member 104, located away from and axially spaced from the base member 102 by a predetermined amount, includes an exposed end face 116 that engages a slide of the handgun as the barrel is received in the cylindrical member 104 as further explained below. In one contemplated embodiment, the cylindrical member 104 has an overall height dimension $H_2$ (FIG. 1), measured from the base member 102, of about 2.44 inches (6.20 cm).

As those in the art would know and understand, the handgun barrel diameter may vary in different types of pistols, and in contemplated embodiments the inner diameter $D_3$ of the cylindrical member 104 is selected to be about 0.625 inches (1.59 cm) that is compatible with so-called "standard" barrels of known handguns. In another embodiment the inner diameter $D_3$ of the cylindrical member 104 is selected to be about 0.75 inches (1.91 cm) that is compatible with so-called "heavy" or "bull" barrels of existing handguns. In either case, the outer diameter $D_2$ of the side wall 114 is larger than the inner diameter $D_3$ by an amount sufficient to provide a desired wall thickness and structural strength, while still rendering the device 100 as small and lightweight as possible. In contemplated embodiments, the outer diameter $D_2$ is about 0.125 inches (0.32 cm) larger than the inner diameter $D_3$.

The guide rod member 106 extends above the transition section 112 of the base member 102 and in the embodiment shown extends as an inner column or post that is concentric with the side wall 114 of the cylindrical member 104. The guide rod member 112 is coaxial with the cylindrical member 104 and is formed with a round or cylindrical side wall 118 extending perpendicular to the bottom wall 108 of the base member 102. In one contemplated embodiment, the side wall 118 of the guide member 106 has an outer diameter $D_4$ of about 0.32 inches (0.81 cm). The outer diameter $D_4$ of the guide rod member 106 is less than the inner diameter $D_3$ of the cylindrical member side wall 114 such that a uniform cavity 120 is defined between them that receives and accepts the barrel of the handgun in use as demonstrated below. The outer diameter $D_4$ of the guide member 106 is also less than a diameter of the bore in the handgun barrel, such that the guide rod member 106 may be received and accepted in the bore of the barrel when the device 100 is used. The guide rod member 106 is seen in the Figures to extend an axial distance, corresponding to the height dimension $H_3$ (FIG. 1) of about 0.31 inches (0.78 cm), above the end face 116 of the cylindrical member 104. As such, the guide rod member 106 projects above the end face 116 such that it can be received in the inner bore of the barrel before the outer surface of the barrel is received in the cavity 120. The handgun barrel may accordingly be engaged to the device 100 in a self-aligning manner in use, first with the bore of the barrel as it engages the guide rod 106 and second with the outer portion of the barrel as it descends into the cavity 120. The device 100 is therefore more user friendly than some existing charging assist devices and systems requiring the user to establish and maintain proper alignment of the handgun for charging purposes.

Given the exemplary dimensions set forth above, the device 100 is only about 3 inches (7.62 cm) tall and about one inch wide in a contemplated embodiment, and is therefore compact enough to easily and comfortably fit in a person's pocket or bag without occupying an undue amount of space. The device 100 is accordingly easily transportable in a compact and lightweight form. It is recognized, however, that the dimensions set forth above are exemplary only and that other dimensions are possible in the device 100.

As shown in FIG. 2, the device 100 is shown to be formed in an integral or single piece construction including the base member 102, the cylindrical member 104 and the guide rod 106. This type of structure or construction is specifically contrasted with separately fabricated and provided component pieces that are assembled to one another. In certain contemplated embodiments, the device 100 may be fabricated in a single piece using one material such as, for example, injection molded plastic techniques, extrusion processes, three dimensional printing processes or other known techniques. While plastic materials are advantageous from a manufacturing and weight perspective, it is understood that non-plastic materials (including but not limited to metal materials such as aluminum, brass, and steel) could likewise be utilized to form one or more of the portions 102, 104, 106 described as desired. Likewise, the portions 102, 104 and 106 need not be fabricated from the same material in all embodiments (e.g., combinations of plastic and metal may be used as desired in different portions 102, 104, 106). Metal portions may be fabricated from, for example, known stamping, casting, or machining processes into the shapes and proportions shown. In still other embodiments, composite materials may also be utilized to fabricate some or all of the portions 102, 104, 106 described using known techniques.

In the racking assist device 100 shown in FIGS. 1-4, a non-slip element having a non-slip surface 120 may be provided on the bottom wall 108 of the base member 102 to aid in reliably locating the device 100 in position on a support surface for use. In contemplated embodiments, the non-slip surface 120 may be separately provided and attached to the bottom wall 108 of the base member 102. One such suitable material for the non-slip element is a self-adhesive material such as Bumpon™ Resilient Rollstock Catalog No. SJ5632 available from the 3M Company (www.3m.com). As one example, the non-slip element may be cut from the resilient rollstock into a flat and round or circular disk having a diameter of about 00.91 inches (2.31 cm) and a thickness of about 0.031 inches (0.08 cm). Various types, shapes and dimensions of non-slip materials may likewise be provided in further and/or alternative embodiments. In some embodiments, the non-slip surface 120 may also be integrally formed in the base member 102 as desired instead of being provided as a separately provided component part. The non-slip surface 120 in some embodiments may also be considered optional and may be omitted.

In use, the base member 102 (including the non-slip surface 120 when present) defines a flat engagement surface that can be seated upon or in abutting contact with another flat surface, referred to herein as a support surface. In the example depicted in the device 100, the support surface may extend horizontally, and when the base member 102 is placed in abutting contact with the support surface the cylindrical member 104 and the guide rod member 106 extend vertically. With the device 100 in place, the barrel of the handgun may be pushed downward onto the device 100 in a vertical orientation against the support surface to charge the handgun as further explained below. Various support surfaces are possible, including but not limited to countertop surfaces, tabletops, floors, walls, a truck bed or tailgate, or even a wheel chair as described below. Practically any support surface can be used, although the support surface should preferably be flat for safety reasons. In some cases, the support surface may include the earth, a rock, a tree stump, a tree or a fence.

When used with a horizontal support surface, the vertically extending members 104, 106 in the device 100 is advantageous in that the device 100 does not require the user to place any other object in front of the muzzle of the handgun in order to charge the handgun for use. Additionally, the vertical orientation of the members 104, 106 provides optimal mechanical leverage and ease of use to assist with the racking process with a simple pressing or pushing force as opposed to possible use of the device 100 using a non-vertical orientation. It is possible, however, that a support surface may be horizontally oriented, vertically oriented, or extend at an angle as long as the user can apply a sufficient force directed generally normal to the support surface (in whatever orientation it happens to be) to move the handgun slide.

Figure 5:
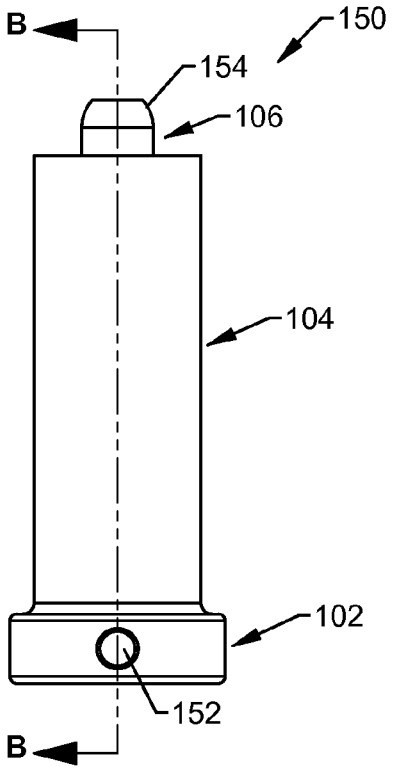
FIG. 5 is a side elevational view of a second exemplary embodiment of a racking assist device for charging a handgun.
Figure 6:
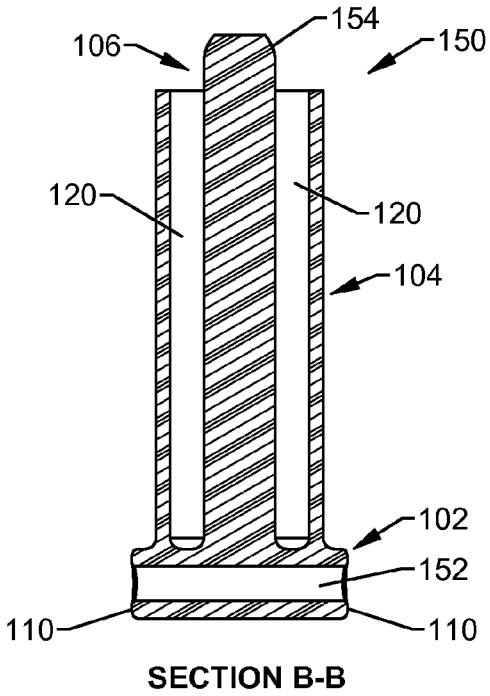
FIG. 6 is a cross sectional view of the racking assist device shown in FIG. 5 and taken along line B-B.
Figure 7:
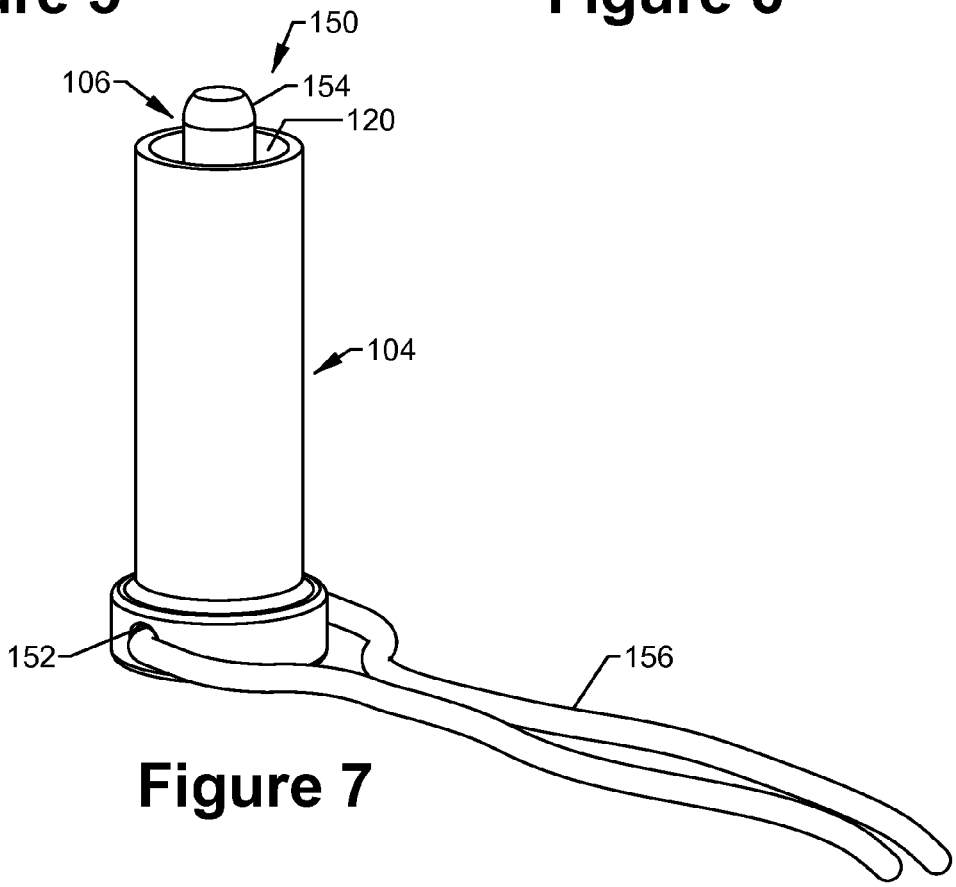
FIG. 7 is a perspective view of the racking assist device shown in FIGS. 6 and 7.

FIGS. 5-7 show another exemplary embodiment of a racking assist device 150 similar in many aspects to the racking assist device 100 described above but including still further features. Like features of the devices 100 and 150 are designated with like reference characters in FIGS. 5-7 and will not be described again. Instead, the present discussion will focus on the new features of the device 150.

As seen in FIGS. 5 and 6, the device 150 includes a through-hole or bore 152 formed in the base member 102. In the example shown, the bore 152 is centered and extends diametrically across the base member 102 such that the ends of the bore 152 extend approximately 180° from one another on the round side wall 110 of the base member 102. Other orientations of the bore 152 are possible, however, and more than one bore or through-hole may be provided. As seem in FIG. 7, a tether in the form of a lanyard 156 may be extended in the bore 152 and coupled to the device 150 for the convenience of the user. In another embodiment, a key chain may be passed though the bore 152 also for the convenience of the user. Other variations are, of course, possible to couple the device 150 to another item via the bore 152 and help the user conveniently carry or locate the device 150 as desired. It is contemplated that a through-hole or bore is not necessarily required to complete such a coupling of the device 150 with another item such as lanyard or keychain, however, and as such other possible attachments are contemplated.

As seen in FIGS. 5-7, the guide rod member 106 of the device 150 also includes a tapered distal end 154 that somewhat resembles a flattened bullet. The tapered end 154 facilitates still further ease of alignment of the guide rod member 106 with the inner bore of the handgun barrel when the device 150 is used. The tapered end 154 will accommodate some initial misalignment of the guide rod member 106 and the inner bore of the barrel and naturally re-align the inner bore of the handgun barrel with the guide rod member 106 as the barrel is engaged with the device 150.

Figure 8:
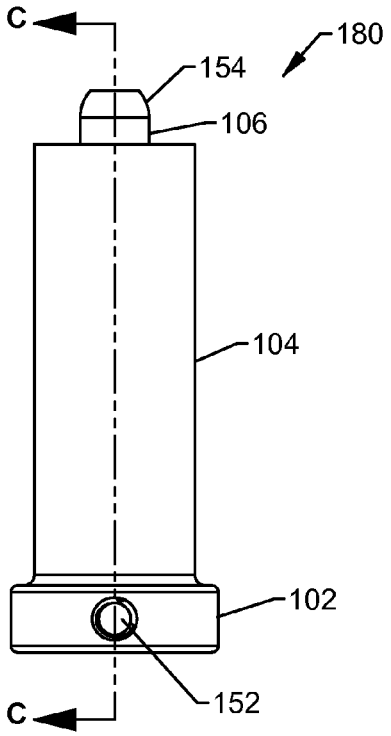
FIG. 8 is a side elevational view of a third exemplary embodiment of a racking assist device for charging a handgun.
Figure 9:
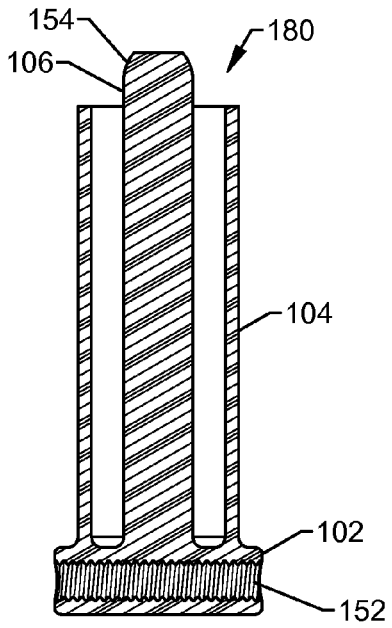
FIG. 9 is a cross sectional view of the racking assist device shown in FIG. 8 and taken along line C-C.
Figure 10:
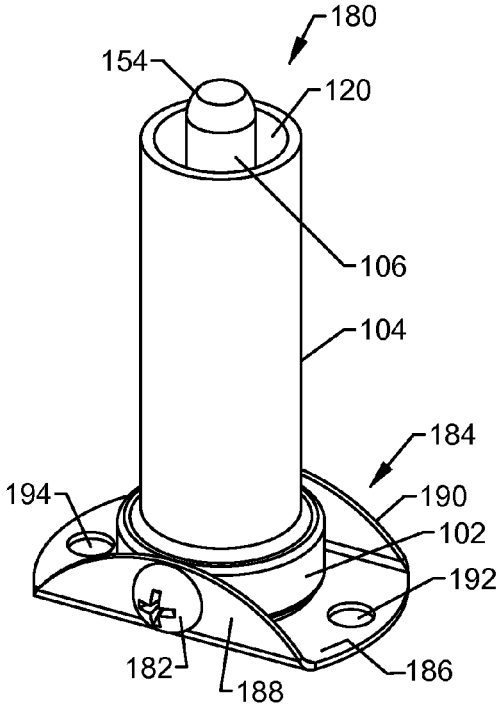
FIG. 10 is a perspective view of the racking assist device shown in FIGS. 8 and 9 in combination with a first exemplary mounting bracket.

FIGS. 8-10 show another exemplary embodiment of a racking assist device 180 similar in many aspects to the racking assist device 150 described above but including still further features. Like features of the devices 180 and 150 are designated with like reference characters in FIGS. 8-10 and will not be described again. Instead, the present discussion will focus on the new features of the device 180.

As seen in the cross sectional view of FIG. 9, the through-hole or bore 152 is tapped or threaded to receive and engage a threaded fastener 182 (FIG. 10) such as a machine screw in one embodiment. As such, the fastener 182 may secure the device 180 in a desired location or orientation with respect to a support surface.

As also seen in FIG. 10, the fastener 182 may secure the device 180 to a mounting bracket 184. In the example shown, the mounting bracket 184 includes a flat and planar base section 186 and opposing side sections 188, 190 extending perpendicular to the plane of the flat base section 186. The side sections 188, 190 are provided with respective openings through which the fastener 182 may be extended. While in FIG. 10 one fastener 182 is visible, a second fastener may be provided and coupled to the bore 152 with threaded engagement at a location opposite the fastener 182.

Openings or apertures 192 and 194 are provided in the base section 186 of the mounting bracket 184 to mount the base section 186 to the desired support surface via additional fasteners such as screws. The support surface, in different embodiments, may be fixed in location (e.g., a countertop), may be stationary (e.g., a tabletop), may be mobile (e.g., an all-terrain vehicle or a truck) or may be portable by a person (e.g., a piece of wood) in various embodiments. While an exemplary mounting bracket 184 is shown and described, various other types and structures of mounting brackets are possible. Also, in the example of FIG. 10, the device 180 is mounted in an upright or vertical position on the bracket 184, while the device 180 could alternatively be mounted in an inclined or angled position using another type of mounting bracket.

It should also be noted that another type of fastener could be used to mount the device 180 that does not necessarily required the bore 152 to be threaded. As one example, a bolt and nut could be used to mechanically mount the device 180 in a desired location, with or without the mounting bracket 184. Other variations using other types of fasteners are likewise possible.

Figure 11:
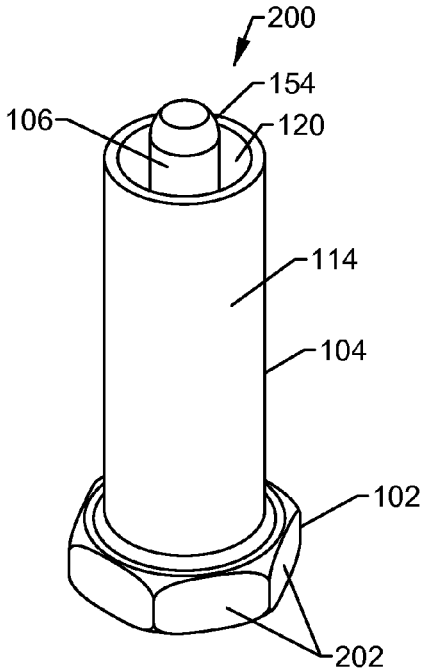
FIG. 11 is a perspective view of a fourth exemplary embodiment of a racking assist device for charging a handgun.

FIG. 11 shows another exemplary embodiment of a racking assist device 200 similar in many aspects to the racking assist device 100 described above but including still further features. Like features of the devices 200 and 100 are designated with like reference characters in FIG. 11 and will not be described again. Instead, the present discussion will focus on the new features of the device 200. Comparing FIG. 3 and FIG. 11, it is seen that the device 200 includes a polygonal side wall 202 in the base member 102 instead of the round wall 110. Depending on the particular material and process utilized to form the base member 102, the polygonal side wall 202 may facilitate an easier fabrication of the device 100 and/or may reduce the amount of material and weight in the completed device 202. The polygonal side wall may have additional benefits in allowing the base to be gripped with a tool such as a pair of pliers to secure it in place for use without having to more permanently mount the device 200 to a supporting structure first. Alternatively, the polygonal side wall may facilitate the fastening of the device 200 to a support housing using known tools such as wrench, or facilitate a position inside a complementary aperture in a support surface and effectively prevent rotation of the device 200 relative to the support surface. Numerous polygonal and non-polygonal but non-round or non-circular side walls are possible in further and/or alternative embodiments.

It is also contemplated that in some embodiments the inner wall of the cylindrical member 104 and/or the outer side wall 114 of the cylindrical member 104 may be non-round as well, including but not necessarily limited to polygonal as desired, with similar benefits to those described above. It is also contemplated that in some embodiments the guide rod 106 may be non-round as well, including but not necessarily limited to polygonal and wherein an x-shape would serve similar benefits to those described above.

Figure 12:
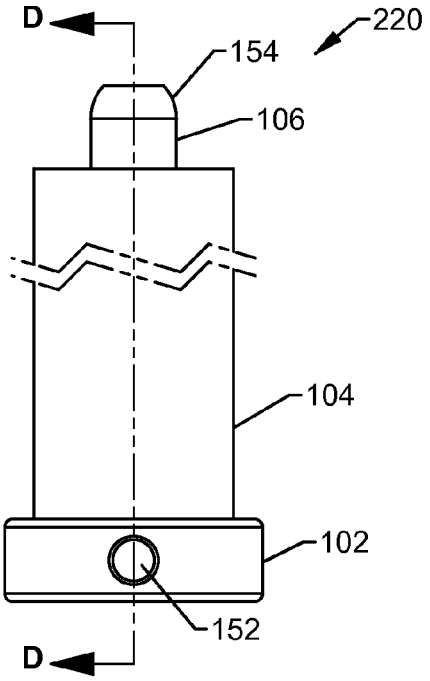
FIG. 12 is a side elevational view of a fifth exemplary embodiment of a racking assist device for charging a handgun.
Figure 13:
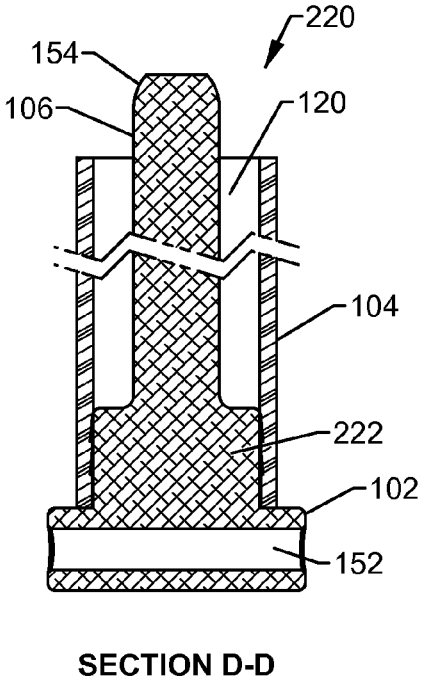
FIG. 13 is a cross sectional view of the racking assist device shown in FIG. 12 and taken along line D-D.

FIGS. 12 and 13 show another exemplary embodiment of a racking assist device 220 similar in many aspects to the racking assist device 150 described above but including still further features. Like features of the devices 220 and 150 are designated with like reference characters in FIGS. 12 and 13 will not be described again. Instead, the present discussion will focus on the new features of the device 200.

As seen in the cross sectional view of FIG. 13, the base member 102 and the guide rod 106 are integrally formed from a first material (e.g., a metal material) while the cylindrical member 104 is separately fabricated and formed from a second material such as plastic. The one piece base member 102 and the guide rod 106 is further formed with a transition section 222 over which a portion of the cylindrical member 104 is extended in the assembly as shown. Various other shapes and structures of a one piece base member 102 and the guide rod 106 are possible, however, in further and/or alternative embodiments.

Figure 14:
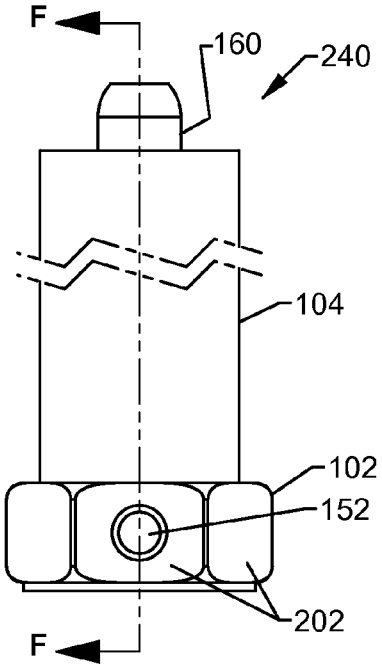
FIG. 14 is a side elevational view of a sixth exemplary embodiment of a racking assist device for charging a handgun.
Figure 15:
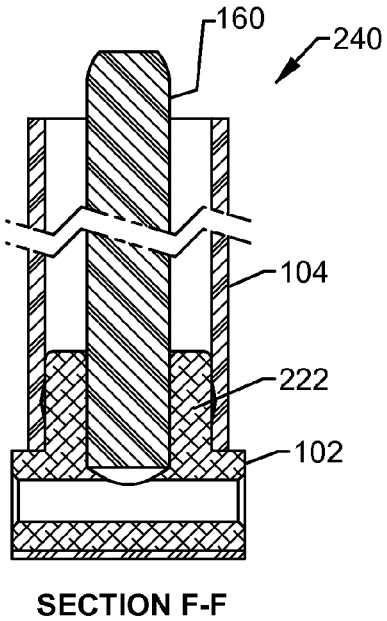
FIG. 15 is a cross sectional view of the racking assist device shown in FIG. 14 and taken along line F-F.

FIGS. 14 and 15 show another exemplary embodiment of a racking assist device 240 similar in many aspects to the racking assist devices 150 and 200 described above but including still further features. Like features of the devices 150 and 200 are designated with like reference characters in FIGS. 14 and 15 and will not be described again. Instead, the present discussion will focus on the new features of the device 240.

As shown in the cross sectional view of FIG. 15, the base member 102 is fabricated from a first material and includes the transition section 222, while the guide rod member 106 is fabricated from a second material and is assembled to the base member 102. The cylindrical member 104 is fabricated from a third material and is assembled to the base member 102. As such, the base member 102, the cylindrical member 104 and the guide rod 106 are fabricated as three separate component parts or pieces that are assembled with one another to provide the assembly as shown in the device 240. The respective materials for the component parts 102, 104 and 106 may include plastic materials, metal materials and composite materials as discussed above. Various combinations of component parts 102, 104 and 106 are possible.

Figure 16:
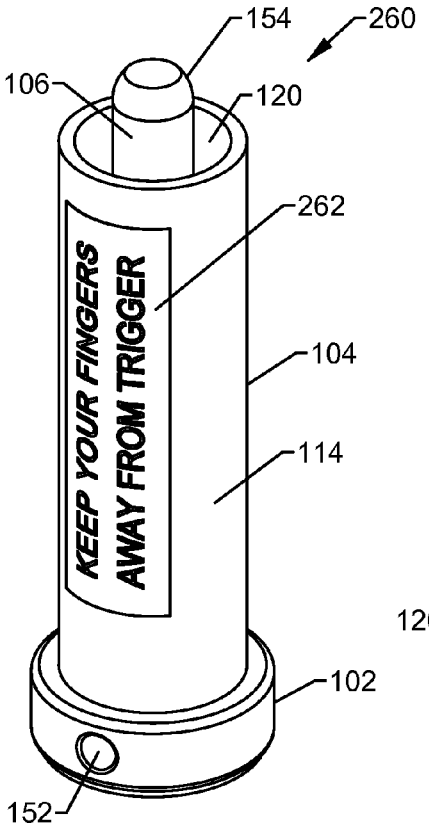
FIG. 16 is a perspective view of a seventh exemplary embodiment of a racking assist device for charging a handgun.

FIG. 16 shows another exemplary embodiment of a racking assist device 260 similar in many aspects to the racking assist device 150 described above but including still further features. Like features of the devices 260 and 150 are designated with like reference characters in FIG. 16 and will not be described again. Instead, the present discussion will focus on the new features of the device 260. Comparing FIGS. 7 and 16, it is seen that the device 260 includes indicia 262 in the form of a label applied to the side wall 114 of the cylindrical element 104 and including a safety reminder for proper use of the device 260 to charge a handgun. In the example shown, the indicia instructs the user to "keep your fingers away from trigger". Other messages or instructions may be provided in other embodiments. Additionally, other information may be provided in the indicia 262 including a device model number, a compatibility code related to use of the device 260 with certain types of handguns, or even user-selected information allowing the owner of the device 260 to distinguish it from other types of devices. In certain embodiments, the indicia could be molded, cast, or engraved for example in the side wall 114 of the cylindrical element 104 in lieu of a label.

Figure 17:
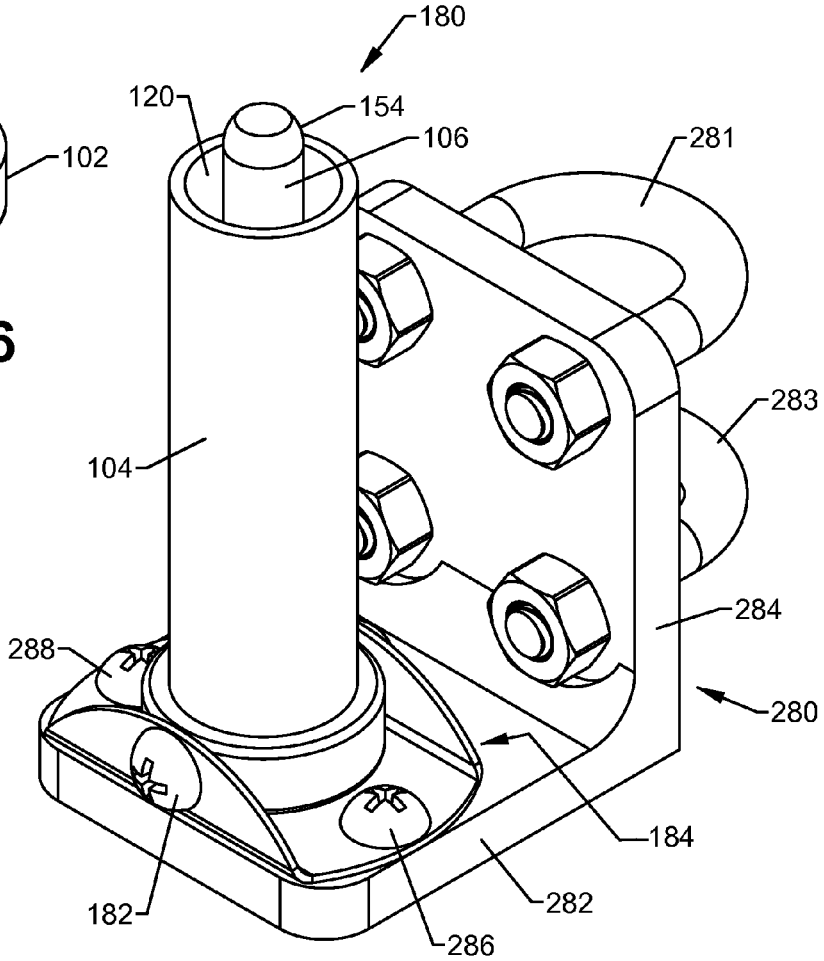
FIG. 17 is a perspective view an exemplary racking assist device in combination with exemplary first and second mounting brackets.

FIG. 17 shows the device 180 including the mounting bracket 184 (FIG. 10), in this embodiment referred to as a primary mounting bracket, in combination with a secondary mounting bracket 280. The mounting bracket 280 includes a generally horizontally extending planar base support section 282 and a generally vertically extending anchor section 284. The mounting bracket 184 is coupled to the base support section 282 via fasteners 286, 288. The anchor section 284 includes U-shaped hanger elements 281, 283 and associated fasteners. In contemplated embodiments, the U-shaped hanger elements may be coupled to a vertically oriented frame element of, for example, a wheelchair (not shown). In other embodiments, the anchor section 284 may be mounted to a vertical support surface such as a wall or a post. Regardless, because of the base support section 282 extending normally or perpendicularly to the anchor section 284, the racking assist device 180 extends generally parallel to the vertically extending support member for use in charging a handgun.

FIG. 18-21 illustrate a handgun charging method or process for a semi-automatic handgun 290 including a muzzle 292, a barrel 294, and a slide 296. The method is implemented with a racking assist device 300 that may represent any of the racking assist devices 100, 150, 180, 200, 220, 240 and associated mounting features and brackets described above.

Figure 18:
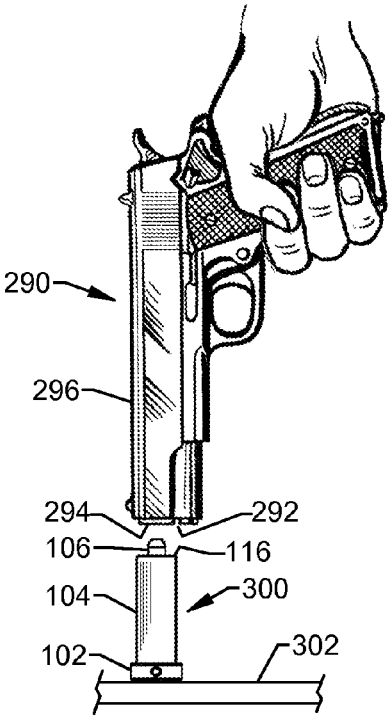
FIG. 18 is a side view of a first process stage of charging a handgun with a racking assist device such as that shown in the preceding figures.
Figure 19:
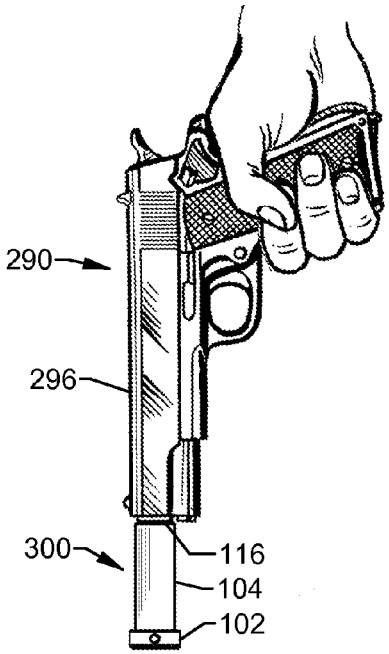
FIG. 19 is a side view of a second process stage of charging a handgun with the racking assist device.

As shown in FIG. 18, the racking assist device 300 is seated upon or against a support surface 302 which may be any of the support surfaces discussed above. A mounting bracket such as the brackets 184 and 280 may be used to fix the device 300 to the surface 302 or the device 300 may sit or be placed on the surface 302 without positive attachment. In the example of FIG. 18, the device 300 is oriented vertically. In this position, the muzzle 292 of the handgun 290 is brought into engagement with the device 300. The guide rod member 106 of the device 300 first engages the inner bore of the handgun barrel 294 and as the handgun is descended on the guide rod member 106 the outer surface of the barrel is received in the cavity 120 of the device 300 as shown in FIG. 19. The barrel is slidably engaged and is freely movable relative to the guide rod 106 and the cylindrical member 104 to complete this portion of the process.

From the position shown in FIG. 19, the handgun 290 is pushed downward upon the device 300 and the end face 116 of the cylindrical member 104 engages the end of the handgun slide 296 facing the device 300.

Figure 20:
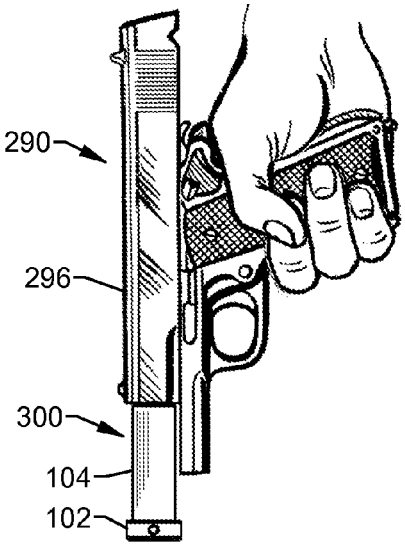
FIG. 20 is a side view of a third process stage of charging a handgun with the racking assist device.
Figure 21:
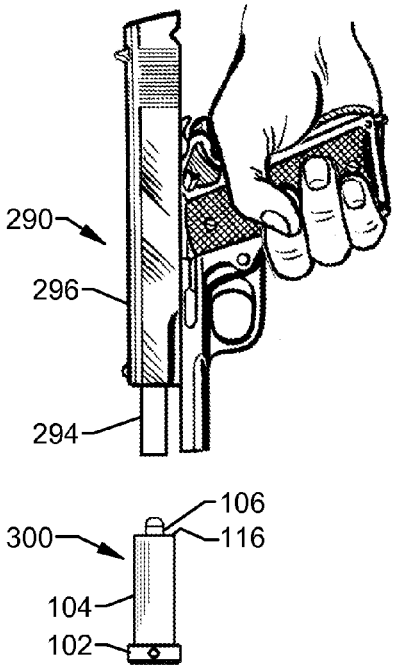
FIG. 21 is a side view of a fourth process stage of charging a handgun with the racking assist device.

As the handgun is continually pushed downward upon the device 300 with the slide 296 in contact with the end face 116 of the cylindrical member 104, the barrel continues to descend into the device cavity 120 of the device 300 and the slide 296 is accordingly moved rearward (i.e., upward in the figures as drawn) on the handgun 290 as shown in FIG. 20. The slide 296 eventually reaches a positive stop as the barrel descends a sufficient distance into the device cavity 120, and as shown in FIG. 21 the handgun 290 may be lifted and separated from the device 300 as shown in FIG. 21. Because there is no positive attachment to the barrel, but instead a simple sliding engagement, a hands-free engagement and disengagement of the handgun 290 and the device 300 is possible.

If a loaded magazine is properly loaded in the handgun 290, the result of the method illustrated in FIGS. 19-21 is that a round from the magazine is chambered and the slide 296 will return to its forward position shown in FIG. 18. The handgun 290 is then charged and ready for use.

If no magazine is was in the handgun 290, the result of the method illustrated in FIGS. 19-21 is that the slide 296 will return to its forward position shown in FIG. 18 without a round being loaded into the chamber.

If an empty magazine is in the handgun 290, the result of the method illustrated in FIGS. 19-21 is that the slide 296 will lock in the rearward position shown in FIG. 21 if the slide 296 was moved sufficiently enough to engage the slide lock of the handgun 290. In certain cases, the slide lock may need to be manually engaged by the user while the slide is displaced as shown in FIG. 20.

The racking method as shown and described can easily be accomplished as shown with one hand on the handgrip of the handgun, although two handed operation is possible with both hands on the handgrip as well as a user may desire. The racking method is further accomplished without pointing the muzzle toward any part of the user's body, and as long as the method is performed with the user's fingers outside the trigger guard and with the pistol pointed away from the user or other persons, the racking method is ensured with a drastically reduced effort on the part of the user as opposed to a conventional, two-handed operation with the one hand's fingers pushing or pulling on the slide 296. Safe completion of the charging process is also improved over conventional accessory charging devices for the reasons described above.

The advantages and benefits of the inventive concepts are now believed to have been amply illustrated in relation to the exemplary embodiments disclosed.

An exemplary embodiment of a racking assist device for a semi-automatic handgun having a barrel, a bore in the barrel, and a slide has been disclosed. The racking assist device includes: a base member; a cylindrical member coupled to the base member, the cylindrical member having an inner diameter that is larger than an outer diameter of the barrel and a face dimensioned to engage the slide; and a guide rod member extending above the cylindrical member, the guide rod member having an outer diameter less than a diameter of the bore and also less than the inner diameter of the cylindrical member, wherein a cavity is defined between the guide rod member and the cylindrical member to receive the barrel to a sufficient depth to allow the cylindrical member to move the slide when the barrel is inserted into the cavity.

Optionally, the base member may include a round side wall or a polygonal side wall. A non-slip element may be attached to the base member. The base member may be formed with a through-hole, and a lanyard or keychain may be attached to the base member via the through-hole. The through-hole may be threaded.

A mounting bracket may be attached to the base member via the through-hole. The mounting bracket may be attached to a supporting structure. The mounting bracket may be attachable to a wheel chair. The mounting bracket may be attached to a table or bench. The mounting bracket may be attachable to a vehicle.

As further options, the base member and guide rod member may be fabricated as one piece and wherein the cylindrical member is fabricated as a second piece. Alternatively, the base member, the guide rod member, and the cylindrical member may each be separately fabricated pieces. A label may also be provided on the cylindrical member. The guide rod member may have a flattened bullet-nose end.

An exemplary method of racking a slide of a handgun with a racking assist device has also been disclosed. The racking assist device includes a base member, a guide rod member and a cylindrical member, and the method includes: positioning the base member of the racking assist device against a surface with the guide rod accessible to receive a muzzle of the handgun; aligning the muzzle over the guide rod; placing the handgun over the guide rod such that a front face of a slide of the handgun engages the cylindrical member; pressing the pistol against the cylindrical member, thereby forcing the slide toward a rear of the handgun; and moving the handgun away from racking assist device.

Optionally, the method may include attaching the racking assist device to the surface.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A racking assist device for a semi-automatic handgun having a barrel, a bore in the barrel, and a slide, wherein the racking assist device comprises:

a base member;

a cylindrical member coupled to the base member, the cylindrical member having an inner diameter that is larger than an outer diameter of the barrel and a face dimensioned to engage the slide;

a guide rod member extending above the cylindrical member, the guide rod member having an outer diameter less than a diameter of the bore and also less than the inner diameter of the cylindrical member, wherein a cavity is defined between the guide rod member and the cylindrical member to receive the barrel to a sufficient depth to allow the cylindrical member to move the slide when the barrel is inserted into the cavity; and a non-slip element attached to the base member.

2. A racking assist device for a semi-automatic handgun having a barrel, a bore in the barrel, and a slide, wherein the racking assist device comprises:

a base member;

a cylindrical member coupled to the base member, the cylindrical member having an inner diameter that is larger than an outer diameter of the barrel and a face dimensioned to engage the slide; and a guide rod member extending above the cylindrical member, the guide rod member having an outer diameter less than a diameter of the bore and also less than the inner diameter of the cylindrical member, wherein a cavity is defined between the guide rod member and the cylindrical member to receive the barrel to a sufficient depth to allow the cylindrical member to move the slide when the barrel is inserted into the cavity;

wherein the base member is formed with a through-hole; and wherein the through-hole is threaded.

3. A racking assist device for a semi-automatic handgun having a barrel, a bore in the barrel, and a slide, wherein the racking assist device comprises:

a base member;

a cylindrical member coupled to the base member, the cylindrical member having an inner diameter that is larger than an outer diameter of the barrel and a face dimensioned to engage the slide; and a guide rod member extending above the cylindrical member, the guide rod member having an outer diameter less than a diameter of the bore and also less than the inner diameter of the cylindrical member, wherein a cavity is defined between the guide rod member and the cylindrical member to receive the barrel to a sufficient depth to allow the cylindrical member to move the slide when the barrel is inserted into the cavity;

wherein the base member is formed with a through-hole; and a mounting bracket attached to the base member via the through-hole.

4. The racking assist device of claim 3, wherein the mounting bracket is attached to a supporting structure.

5. The racking assist device of claim 3, wherein the mounting bracket is attachable to a wheel chair.

6. The racking assist device of claim 3 wherein the mounting bracket is attached to a table or bench.

7. The racking assist device of claim 3 wherein the mounting bracket is attachable to a vehicle.

8. A method of racking a slide of a handgun with a racking assist device, the racking assist device including a base member with a through-hole, a guide rod member and a cylindrical member, the method comprising attaching the base member via the through-hole of the racking assist device to a surface with the guide rod accessible to receive a muzzle of the handgun;

aligning the muzzle over the guide rod;

placing the handgun over the guide rod such that a front face of a slide of the handgun engages the cylindrical member;

pressing the pistol against the cylindrical member, thereby forcing the slide toward a rear of the handgun; and moving the handgun away from the racking assist device.

* * * * *